United States Patent [19]

Korsunsky

[11] Patent Number: 4,547,031

[45] Date of Patent: Oct. 15, 1985

[54] CHIP CARRIER SOCKET AND CONTACT

[75] Inventor: Iosif Korsunsky, Harrisburg, Pa.

[73] Assignee: AMP Incorporated, Harrisburg, Pa.

[21] Appl. No.: 625,996

[22] Filed: Jun. 29, 1984

[51] Int. Cl.[4] ..... H01R 9/09

[52] U.S. Cl. ..... 339/75 M; 339/17 CF

[58] Field of Search ..... 339/17 CF, 75 M, 75 MP, 339/176 M, 176 MP

[56] References Cited

U.S. PATENT DOCUMENTS

| | | | |
|---|---|---|---|
| 3,719,917 | 3/1973 | Fischer et al. | 339/17 CF |
| 3,874,768 | 4/1975 | Cutchaw | 339/17 CF |
| 4,252,390 | 2/1981 | Bowling | 339/17 CF |
| 4,354,718 | 10/1982 | Bright et al. | 339/17 CF |
| 4,461,524 | 7/1984 | McGhee | 339/17 CF |

*Primary Examiner*—John McQuade

*Attorney, Agent, or Firm*—Donald M. Boles

[57] ABSTRACT

A chip carrier socket and contact which provides high contact mating forces and short circuit path length is taught. Briefly stated, a chip carrier socket housing is comprised of a base portion having contacts disposed therein with a retainer portion being placed thereon. A chip carrier having conductive leads is placed between the base and the retainer. The retainer has a spring carrier piece contained therein with the spring carrier acting on fingers which are part of the retainer. The retainer fingers urge the conductive leads of the chip carrier into electrical contact with the contact thereby utilizing the contacts as points of electrical communication only and not for exerting contact mating force.

4 Claims, 3 Drawing Figures

CHIP CARRIER SOCKET AND CONTACT

BACKGROUND OF THE INVENTION

This invention relates, generally, to a chip carrier socket and contact and, more particularly, to a chip carrier socket which provides an extremely short contact length while providing extremely high contact mating forces.

Attendant with higher density and higher speed chip carriers is the need to keep contact lengths short so as to minimize capacitive, inductive and resistive effects which may introduce errors into the system. Heretofore, however, most schemes which attempt to utilize circuit paths have overall contact lengths which do introduce some adverse effects but which are generally necessary so as to obtain proper member lengths for force or moment arm purposes. Examples of these types of contacts may be found in U.S. Pat. No. 4,349,238 entitled "Integrated Circuit Package Connector" issued Sept. 14, 1982 to Showman et al; U.S. Pat. No. 4,341,433 entitled "Active Device Substrate Connector" issued July 27, 1982 to Cherian et al; and U.S. Pat. No. 4,334,727 entitled "Connector for a Leadless Electonic Package" issued June 15, 1982 to Sheingold et al.

It would be advantageous to have a device which accomplishes extremely short contact or circuit path lengths while not having an overall contact length which is considerably longer than the circuit path.

It would also be advantageous to have a device which provides sufficiently high contact mating forces such that tin or another non-precious metal may be utilized on the surface of the contact.

Also advantageous would be a device which is relatively inexpensive as well as easy to manufacture. Such a device is taught by the present invention.

Accordingly, the present device teaches and as an object of the invention a chip carrier socket comprising a chip carrier having conductive leads, a contact for providing electrical communication from the conductive leads therethrough, a base plate profiled to receive the chip carrier and having a plurality of upstanding housing latch members, with the contact extending through the base plate and being disposed adjacent the conductive leads with a retainer profiled to be placed over the chip carrier and the base plate with recesses therein for complementary latching engagement with the upstanding housing latch members, characterized in that the retainer has a cavity therein and a plurality of flexible arms or fingers in corresponding engagement with the conductive leads and a spring carrier disposed in the cavity for resiliently urging the flexible arms or fingers inwardly towards the conductive leads so as to cause contacting mating force between the conductive leads and the contact.

BRIEF DESCRIPTION OF THE DRAWINGS

Reference is now made to the accompanying drawings in which.

DETAILED DESCRIPTION OF THE PREFERRED EMBODIMENT

Figure 1:
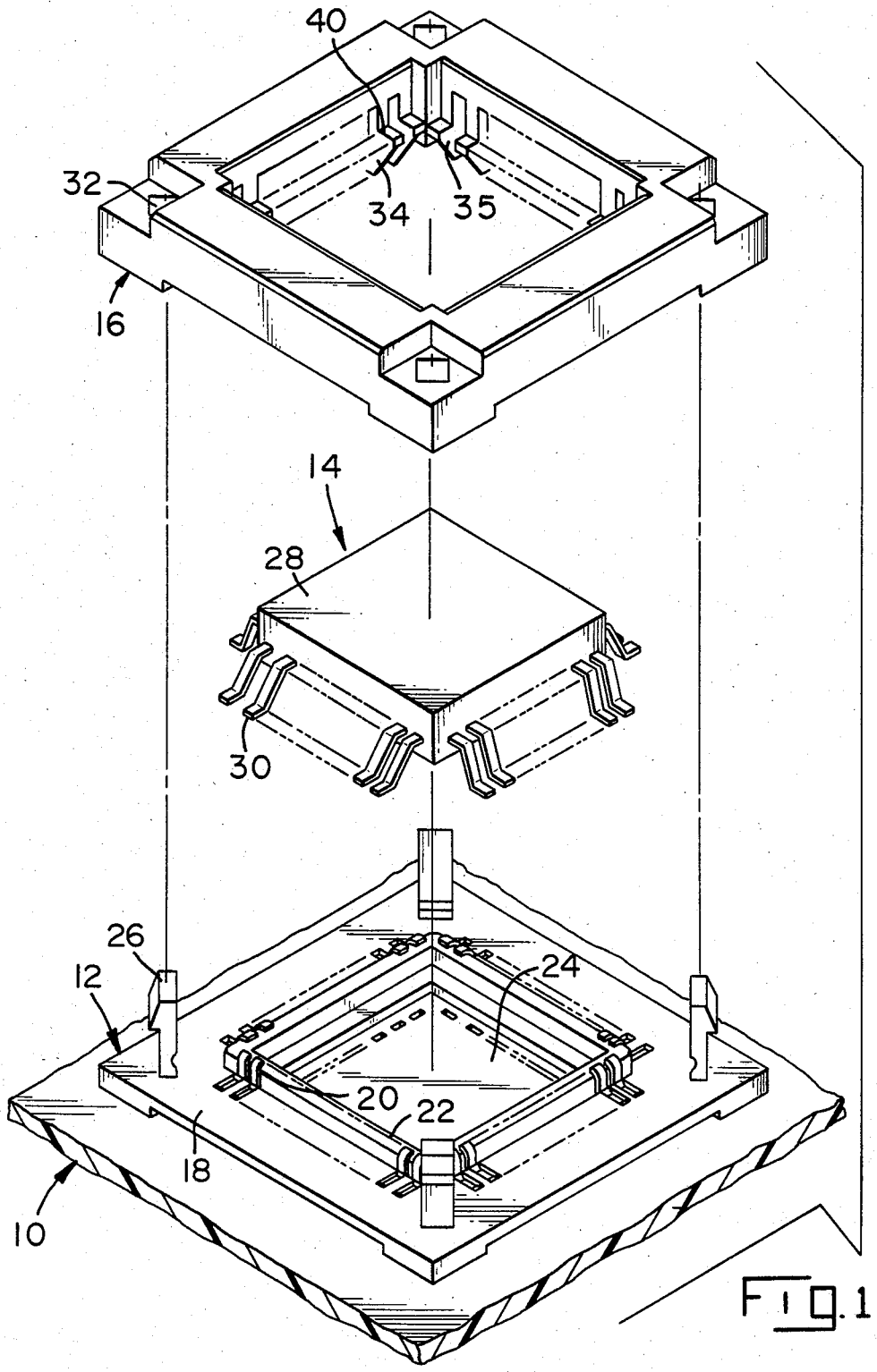
FIG. 1 is an exploded isometric drawing of the chip carrier and socket of the present invention in conjunction with a circuit board.

Referring now to FIG. 1, there is illustrated an exploded isometric view of the present invention. Shown is a printed circuit board 10 having disposed thereon a base plate shown generally at 12. A chip carrier 14 is disposed between the base plate 12 and a retainer shown generally at 16. The base plate 12 is comprised of a frame 18 having contacts 20 disposed therein with contact stops 22 disposed adjacent the contacts 20 and around the aperture 24 which is disposed in the center of the frame 18. Latching members 26 are disposed at each corner of the frame 18 so as to be engageable with corresponding recesses 32 which are contained in the retainer 16. The chip carrier 14 is comprised of a ceramic portion 28 having chip carrier conductive leads 30 around the periphery thereof. The retainer 16 has flexible arms or fingers 34 having spaces 35 disposed therebetween thereby allowing independent movement amongst the fingers 34. The fingers 34 also provide suitable contact mating force between the chip carrier conductive leads 30 and the contacts 20 (as shown more clearly in FIGS. 2 and 3). The base plate 12 and the retainer 16 in the preferred embodiment of the present invention are comprised of plastic which has been injection molded, although other materials and methods can and may be utilized without departing from the spirit and scope of the present invention. During assembly of the apparatus, the chip carrier 14 is placed onto the frame 18 with the retainer 16 thereafter place over the chip carrier 14 with the recesses 32 contained in the retainer 16 positioned so as to engage the housing latching members 26 contained on the frame 18. Therefore, when the retainer 16 is pressed downward onto the frame 18, the latches 26 engage the recesses 32 thereby relatively fixedly securing the chip carrier 14 between the retainer 16 and the frame 18. This also causes a contact wiping action between the contacts 20 and the conductive leads 30 (as shown more clearly in FIG. 2).

Figure 2:
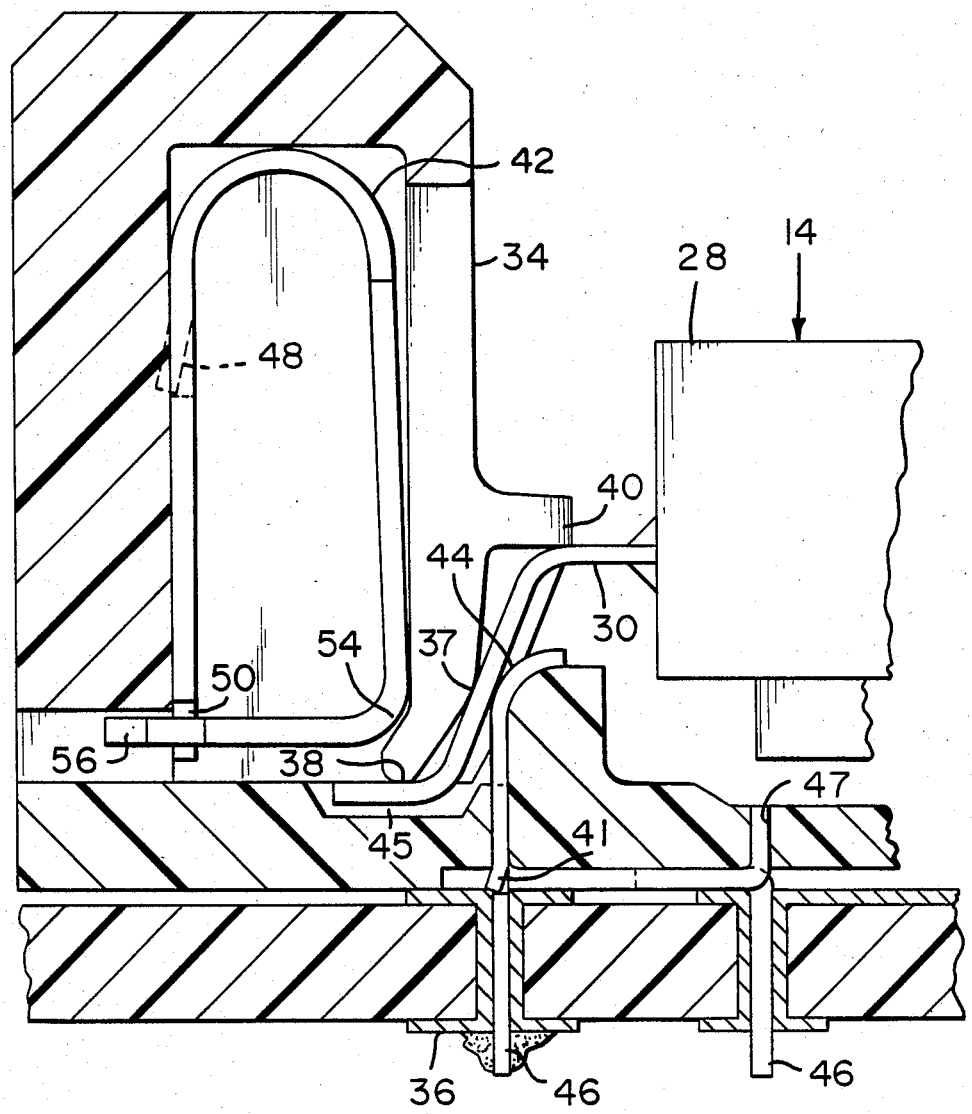
FIG. 2 is a cross-sectional view taken through a portion of the assembled device of FIG. 1.

Referring now to FIG. 2, there is illustrated via a cross-sectional view, the contact mating aspects of the present invention. The circuit board 10 has conductive strips 36 thereon although it is to be understood that other types of circuit boards can be utilized such as screen printed. Plated through holes are used in the circuit board 10 which engage the stem 46 of the contacts 20. A tab 41 contained on alternating contacts 20 maintains the contact 20 in the frame 18. The frame 18 has frame recesses 45 which provide space for the lower portion of the conductive leads 30. Disposed in the retainer 16 is a spring carrier piece 42. The spring carrier piece 42 has a spring carrier retaining tab 48 which is used to hold the carrier piece 42 firmly in the retainer 16 (as shown more clearly in FIG. 3). The spring carrier piece 42 is preferably comprised of beryllium copper for its spring properties, although it is to be understood that other materials can be utilized, such as steel or plastic, without departing from the spirit and scope of the present invention. The spring carrier 42 is formed into a closed loop type of structure with a slot 50 cooperating with a spring carrier tab 56 thereby maintaining the carrier 42 in a preloaded condition. The knee portion 54 of the spring carrier 42 cooperates with the flexible arm 34 and urges the flexible arm force exertion point shown generally at 37 to be urged with significantly high contact mating towards the conductive lead 30. This then causes the conductive lead 30 to be forced against the contact mating area shown generally at 44 of the contact 20. Therefore, this provides electrical communication from the conductive lead 30, directly to the contact 20, and thereafter to the conductive strip 36 contained on the circuit board 10. It has been found that this provides an extremely short contact length which greatly diminishes any inductive, capacitive or resistive effects. Further, the action of the knee 54 in cooperation with the flexible arm exertion point 37 utilizes a force in an almost normal direction between the conductive lead 30 and the contact 20. Therefore, the force requirements of the spring carrier piece 42 are kept to a minimum since almost all the force produced by the carrier piece 42 is used for producing the contact mating force thereby allowing the size of the carrier piece 42 to be kept to the minimum as well as allowing the conductive lead 30 and the contact 20 to be plated with preferably tin or any other non-precious conductive metal (although gold may be utilized without departing from the spirit and scope of the present invention). Further, during attachment of the retainer 16 to the base plate 12, a ledge shown generally at 40 contained on the flexible arm 34 in conjunction with hold down portion shown generally at 38 of the flexible arm 34 guides and pushes the conductive lead 30 downward and into place with a contact wiping motion occurring between the conductive lead 30 and the contact mating area shown generally at 44 of the contact 20 thereby removing any oxides or foreign matter which may be present.

Figure 3:
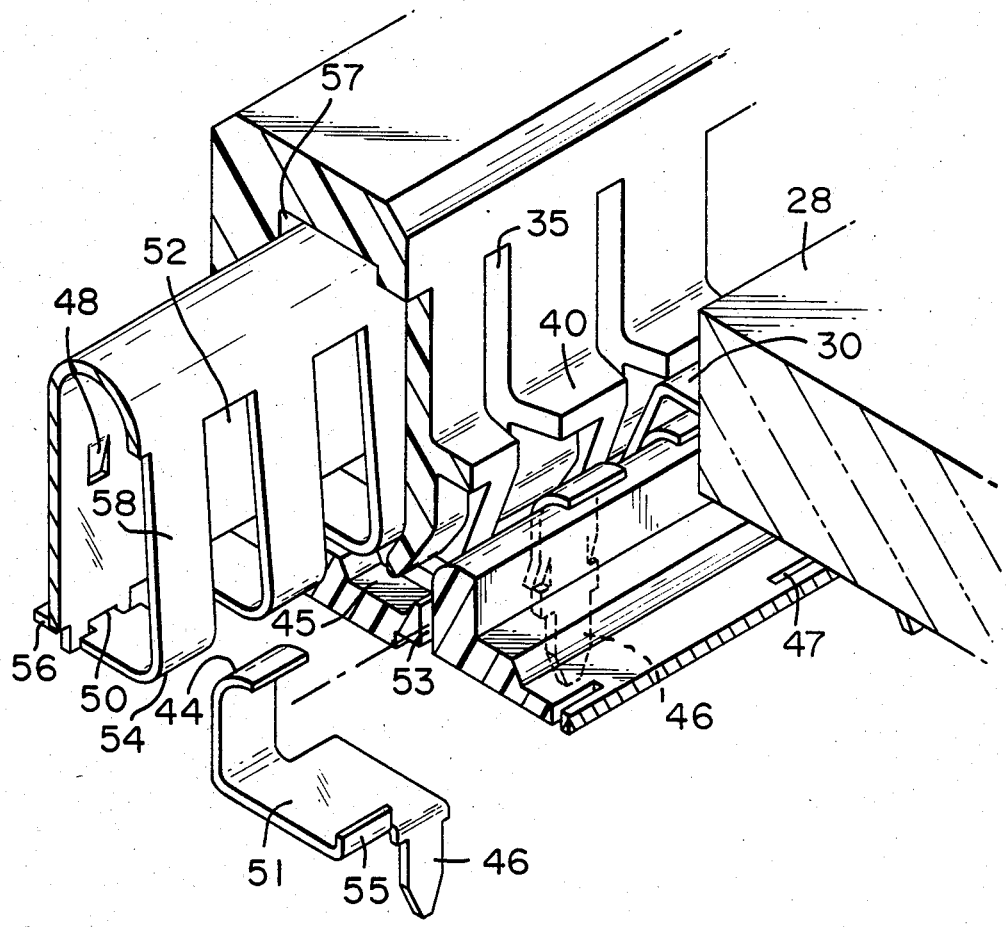
FIG. 3 is a cut-out isometric view showing with more detail the contact arrangement of the present invention and the associated components.

Referring now to FIG. 3, there is illustrated an isometric cross-sectional view showing in greater detail the contact arrangement of the present invention. The contacts used in the present invention utilize two different configurations so as to allow staggering and, therefore, higher center-to-center spacing, although the contact mating area 44 and stem portion 46 are similar and perform the same function. The positioning of the contact 20 in the frame 18 requires that a straight or non-bent contact mating area 44 of the contact 20 be pushed up through the bottom of the frame 18 through contact positioning slots 53 contained therein. As can also be seen, every other contact has a contact base portion 51 having a contact tab 55 at the end thereof. The contact tab 55 fits into the contact alignment aperture 47 contained in the frame 18. Upon insertion of all the contacts 20 into the frame 18, the entire frame 18 is placed into a press (not shown but which is readily within the scope of knowledge for someone similarly skilled in the art) which bends the contact mating area 44 of the contact 20 into the position shown, the contact stop 22 providing a type of form as well as being used as a contact stop for contact mating purposes as shown more clearly in FIG. 2. The spring carrier piece 42 which is disposed in the cavity 57 of the retainer 16 is comprised of a singular contiguous piece, although shorter or discrete portions may be utilized. As mentioned previously, spaces 52 separate spring carrier fingers 58 from each other thereby providing individualized force components for each contact 20 associated with it. The spring carrier 42 is placed into the cavity 57 in a preloaded condition with the slot 50 and spring carrier tab 56 allowing the spring carrier finger 58 to be flexed or moved in conjunction with assembly of the present device.

It is to be remembered that many variations of the present invention may be practiced without departing from the spirit and scope of the present invention. For example, the shape of the spring carrier may be of a different shape such as a triangle or the like while the latching mechanism between the base plate and the frame may be eliminated or other fastening means such as screws may be used. Further, different types of contact alignment apertures such as a groove or recess may be used or they may be eliminated entirely while a different manner of aligning the contacts themselves such as slots can be utilized. Also, the contacts could be placed into a slightly different frame thereby allowing the contacts to be placed into the frame in a pre-bent configuration or could be integrally molded with plastic as part of the frame. Also, different methods of staggering contact stems could be used.

Accordingly the disclosed invention produces a method and device for a chip carrier socket and contact which is extremely simple and inexpensive to manufacture and use while providing very high contact mating forces such that non-precious metals may be used as a plating on the contacts if desired. Further, the present invention provides a scheme which utilizes an extremely short contact path length with the result that inductance, capacitive and resistive impedances are mimimized.

What is claimed is:

1. A chip carrier socket, comprising:

a chip carrier having conductive leads;

contact means for providing electrical communication from said conductive leads therethrough;

base plate means being profiled to receive said chip carrier, having said contact means extending through said base plate means and being disposed adjacent said conductive leads;

retainer means being profiled to be place over said chip carrier and said base plate means and being fastened to said base plate, means characterized in that said retainer means has a cavity therein and a plurality of flexible arms or fingers in corresponding engagement with said conductive leads; and spring carrier means disposed in said cavity for resiliently urging said flexible arms or fingers inwardly towards said conductive leads so as to cause contacting mating force between said conductive leads and said contact means.

2. A chip carrier socket, comprising:

a chip carrier having conductive leads;

contact means for providing electrical communication from said conductive leads therethrough;

base plate means being profiled to receive said chip carrier, having a plurality of upstanding housing latch members, and further having said contact means extending through said base plate means and being disposed adjacent said conductive leads;

retainer means being profiled to be placed over said chip carrier and said base plate means and having recesses therein for complementary latching engagement with said upstanding housing latch members, characterized in that said retainer means has a cavity therein and a plurality of flexible arms or fingers in the corresponding engagement with said conductive leads; and spring carrier means disposed in said cavity for resiliently urging said flexible arms or fingers inwardly towards said conductive leads so as to cause contacting mating force between said conductive leads and said contact means.

3. A device according to claim 1 wherein said contact mating force retains said chip carrier in said chip carrier socket.

4. A device according to claim 2 wherein said contact mating force retains said chip in said chip carrier socket.

* * * * *